US005269513A

United States Patent [19]

Gervais

[11] Patent Number: 5,269,513

[45] Date of Patent: Dec. 14, 1993

[54] COMPACT GOLFING TOOL

[76] Inventor: Debra C. Gervais, 8 Sandy Way, Gloucester, Mass. 01930

[21] Appl. No.: 923,231

[22] Filed: Jul. 31, 1992

[51] Int. Cl.[5] ..... A63B 53/00

[52] U.S. Cl. ..... 273/32 B; 172/380; 15/105; 15/236.01

[58] Field of Search ..... 273/32 B, 32 R, 32 A, 273/32 H; 172/378, 379, 380; 15/105, 111, 236.01

[56] References Cited

U.S. PATENT DOCUMENTS

| | | | |
|---|---|---|---|
| 332,350 | 12/1885 | Kretsinger | 172/380 X |
| 3,185,483 | 5/1965 | Klynman | 273/32 B X |
| 3,203,700 | 8/1965 | Antonious | 273/32 B X |
| 3,310,826 | 3/1967 | Ellis | 15/105 |
| 3,763,515 | 10/1973 | Voss | 15/105 |
| 3,870,300 | 3/1975 | Amendola | 273/32 B |
| 4,787,632 | 11/1988 | Nigrelli et al. | 273/32 B |
| 4,908,899 | 3/1990 | Killen | 15/105 |
| 4,919,861 | 4/1990 | Schutes | 273/32 B X |
| 4,982,471 | 1/1991 | Bannan | 15/105 |
| 5,007,129 | 4/1991 | Hainey | 273/32 B X |
| 5,121,519 | 6/1992 | Haugom | 15/105 |
| 5,195,743 | 3/1993 | Walsh | 15/105 X |

FOREIGN PATENT DOCUMENTS

| | | | |
|---|---|---|---|
| 2247179 | 2/1992 | United Kingdom | 273/32 B |

*Primary Examiner*—George J. Marlo
*Attorney, Agent, or Firm*—Kenway & Crowley

[57] ABSTRACT

A compact golfing tool of uncomplex construction is provided, wherein a body has a pair of prongs at one end and a cleaning blade at the other end, which blade extends laterally across the width of such body. Preferably the cleaning blade, in side profile, is defined by a curved blade side which meets a straight blade side. A gripping area on such body is provided between the ends thereof, which area can include an indented waist-like area, knurled surfaces and/or a thumb-receiving depression.

11 Claims, 1 Drawing Sheet

COMPACT GOLFING TOOL

BACKGROUND OF THE INVENTION

1. Field of the Invention

This invention relates to a compact golfing tool, particularly a multipurpose golfing tool.

2. The Prior Art

Golfers often require one or more tools for cleaning golf club faces and grooves of, e.g. dirt and grass, for repair of ball marks on a green, for divot replacement and the like. Several prior art tools have been proposed for these purposes. See for examples U.S. Pat. No. 4,535,987 to Dikoff (1985) and U.S. Pat. No. 5,022,650 to Madock (1991).

The first reference discloses a relatively complex golf tool with moving parts and pointed projections, including sharp tip 54 for cleaning grooves in golf club faces.

The second reference discloses a more simplified tool, having prongs at one end with a row of bristles at the other end, for club face groove cleaning. These bristles add a complexity to the manufacture of such tool. Such bristles can weaken with use and fail to dislodge stubborn deposits from the club face due to bristle flexure.

The above references are typical of the prior art; they are complex of construction, have bristle flexure or have pointed projections that render them unsuitable for carrying in or retrieving from, a pocket.

Accordingly there is a need and market for an effective, non-pointy, golfing tool of uncomplex construction that overcomes the above prior art shortcomings.

There has now been discovered a golfing tool of uncomplex and streamlined design, that is highly effective in cleaning golf club faces, cleaning the cleated soles of golf shoes, divot replacement and the like, that is of uncomplex and durable construction.

SUMMARY OF THE INVENTION

Broadly the present invention provides a compact golfing tool comprising, a body having a pair of prongs at one end thereof and a cleaning blade at the other end thereof, which blade extends laterally and substantially across the width of the body, which body further has a gripping area thereon between the ends.

By "cleaning blade" is meant a non-sharp blade, suitable for cleaning golf club grooves rather than a cutting blade for, e.g. sharpening a pencil.

The golfing tool embodying the present invention is desirably of streamlined, one piece, one material construction. In a preferred embodiment, the cleaning blade, in profile or in cross-section, is defined by a flat surface joined by a curved surface to define e.g. blade edge 20, shown in FIG. 2 hereof.

BRIEF DESCRIPTION OF THE DRAWINGS

The invention will become more apparent from the following detailed specification and drawings in which.

DESCRIPTION OF PREFERRED EMBODIMENT

Figure 1:
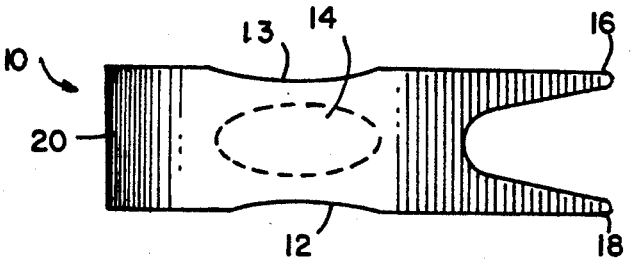
FIG. 1 is a top plan view of the compact golfing tool embodying the present invention.
Figure 2:
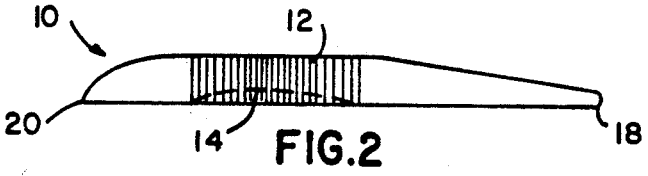
FIG. 2 is a side elevation view of the tool of FIG. 1.

Referring now in more detail to the drawings, compact golfing tool 10 has a central knurled gripping area 12 and a thumb-receiving oval depression 14, for gripping such tool, as shown in FIGS. 1 and 2. At one end of such tool 10 is a pair of prongs 16 and 18, to aid in replacing divots or elevating ball marks or depressions in a putting green, as shown in FIGS. 1 and 2. The other end of such tool 10 carries a cleaning blade edge 20, which is suitable for cleaning grooved faces of golf clubs and cleated soles of golf shoes of soil, grass, pebbles and related deposits.

Figure 3:
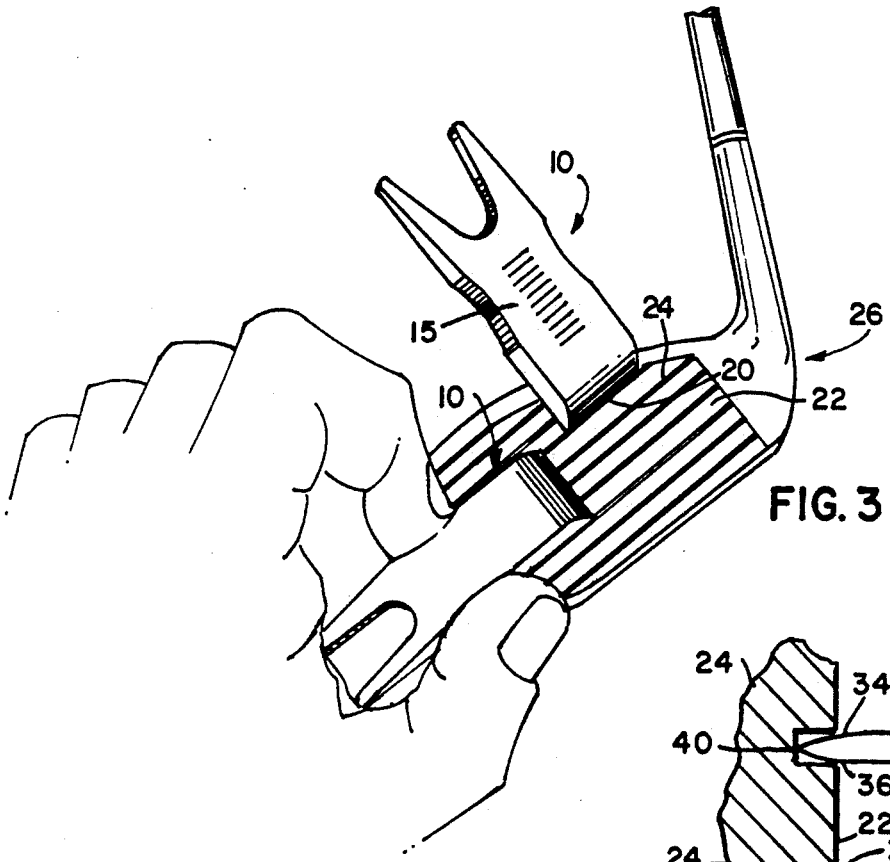
FIG. 3 is a perspective schematic view of tools embodying the invention in use.

In operation, the cleaning blade edge 20 of the golfing tool 10 is employed, e.g. in cleaning the ridges 22 and/or the grooves 24 of the golf club 26, as shown in FIG. 3.

Figure 4:
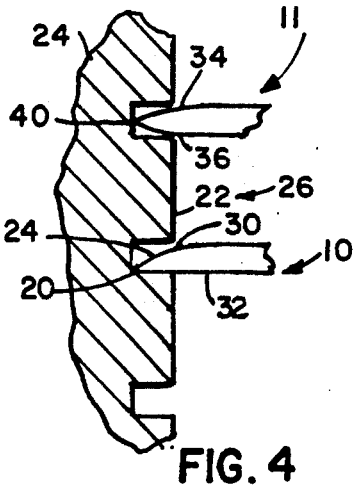
FIG. 4 is a schematic elevation view of two tools embodying the invention in use.

The golfing tool 10 of the invention, desirably has a curved side 30 and a flat side 32, which meet to define cleaning edge 20, as shown in FIG. 4. Such flat profile shape is advantageous in, e.g. cleaning in the corners of the grooves 24 of the golf club 26, as indicated in FIG. 4, and this profile blade shape is preferred. However, the invention also includes a golf tool 11 having in profile, curved sides 34 and 36 which meet to define a cleaning blade edge 40, in a non-flat profile blade shape per FIG. 4.

The streamlined golfing tool of the invention is readily carried in the pocket of the golfer for quick access thereto when needed. Such tool is of uncomplex construction, which permits low-cost manufacture thereof.

Such tool is desirably molded of plastic, such as ABS, polycarbonate and nylon but can be made of other materials if desired, e.g. wood, metal, and the like.

The compact golfing tool of the invention preferably has a knurled gripping area and/or a thumb-receiving depression therein (aiding in comfort and ease of use), e.g. as shown in FIGS. 1 and 2, but need not have either, within the scope of the invention. That is, both of the above gripping aids 12 and 14 for FIGS. 1 and 2, can be omitted if desired, within the scope of the invention.

However, the thumb-receiving depression 14 at the bottom of the tool 10, per FIGS. 1 and 2, is preferably used as follows. For golf club (face) cleaning, the thumb and finger grasp the tool 10 at the opposed knurled or ridged sides 12 and 13, e.g. as shown in FIG. 3.

Alternatively, the tool is turned over and reversed, e.g. for divot replacement and the thumb can rest in such depression 14, with the prongs 16 and 18, of the tool 10, extending outwardly.

A logo 15 can appear on the upper (flat) surface of the tool 10, as indicated in FIG. 3.

Though the blade edge 20 desirably has a profile as shown in FIG. 2, of a rounded surface joining a flat surface, such blade profile can take various other profile shapes, including angular, rounded or a combination thereof as desired, which shapes include parallel or angled sides joined by a curved edge, within the scope of the present invention.

What is claimed is:

1. A compact golfing tool comprising, a body having a predetermined length, a width, and a thickness substantially less than said width defining a side profile, a pair of prongs at one end thereof and a cleaning blade at the other end thereof, which blade extends laterally and substantially across the width of said body and a gripping area on said body between said ends, wherein said cleaning blade in side profile is defined by two opposed side surfaces of said body meeting to define a cleaning blade edge, at least one of which surfaces is curved, and said side profile is indented, in plan view, to provide a pair of opposed indented finger gripping surfaces.

2. The tool of claim 1, wherein the cleaning blade in side profile, is defined by a curved surface meeting a straight surface.

3. The tool of claim 2, wherein the cleaning blade edge extends laterally from said profile across the width of said body.

4. The tool of claim 3, wherein said blade edge is sized to clean the golf club ridges and/or the grooves therebetween.

5. The tool of claim 2, wherein said cleaning blade is sized to clean in the grooves of golf club faces, as well as to clean the ridges thereof.

6. The tool of claim 1, wherein said gripping area includes at least one knurled surface.

7. The tool of claim 1, wherein said gripping area includes a thumb-receiving depression.

8. The tool of claim 7, wherein said gripping area also includes knurled surfaces on two sides of said depression.

9. The tool of claim 1, wherein said indented opposed surfaces are knurled.

10. The tool of claim 1, being of one piece construction.

11. The tool of claim 1, being constructed of plastic material.

* * * * *